United States Patent [19]

Opitz et al.

[11] 4,290,163

[45] Sep. 22, 1981

[54] ARRANGEMENT FOR REMOVAL OF RESIDUES AND SEDIMENTS FROM THE INTERIOR SURFACES OF BARRELS OF WEAPONS

[75] Inventors: Rigobert Opitz, Habichtswald; Juergen Flach, Duesseldorf, both of Fed. Rep. of Germany

[73] Assignee: Rheinmetall GmbH, Duesseldorf, Fed. Rep. of Germany

[21] Appl. No.: 74,040

[22] Filed: Sep. 10, 1979

[30] Foreign Application Priority Data

Sep. 8, 1978 [DE] Fed. Rep. of Germany ..... 2839153

[51] Int. Cl.[3] ..... F41F 17/14; A46B 13/02

[52] U.S. Cl. ..... 15/104.09

[58] Field of Search ..... 15/104.05, 104.09, 104.12, 15/104.13, 104.14, 104.3 R

[56] References Cited

U.S. PATENT DOCUMENTS 3,004,278 10/1961 Stanley ..... 15/104.09 X
3,078,823 2/1963 Cummings et al. ..... 15/104.09 X
4,027,349 6/1977 Clavin ..... 15/104.12

FOREIGN PATENT DOCUMENTS 2335868 1/1975 Fed. Rep. of Germany ... 15/104.09

*Primary Examiner*—Edward L. Roberts

[57] ABSTRACT

A cleaning arrangement for cylindrical bores and in particular gun barrels. The cleaning arrangement, when in operation, automatically axially reciprocates in the gun barrel. The arrangement includes a carrier on which at least one drive motor is mounted. Electrical energy supply means are connected to the drive motor. A container for holding cleaning fluid is also mounted on the carrier and rotary brush means are connected to the drive motor via gear train means. Entering means are mounted on the carrier and maintain the cleaning arrangement in substantial axial alignment with the gun barrel via a plurality of radially outwardly biased drive rollers which bear against the interior surface of the gun barrel. The rotary brush means are rotated by the drive motor via the gear train means about the longitudinal axis of the gun barrel. The drive rollers, when rotated by the drive motor, also serve to axially advance the cleaning arrangement in the gun barrel.

3 Claims, 1 Drawing Figure

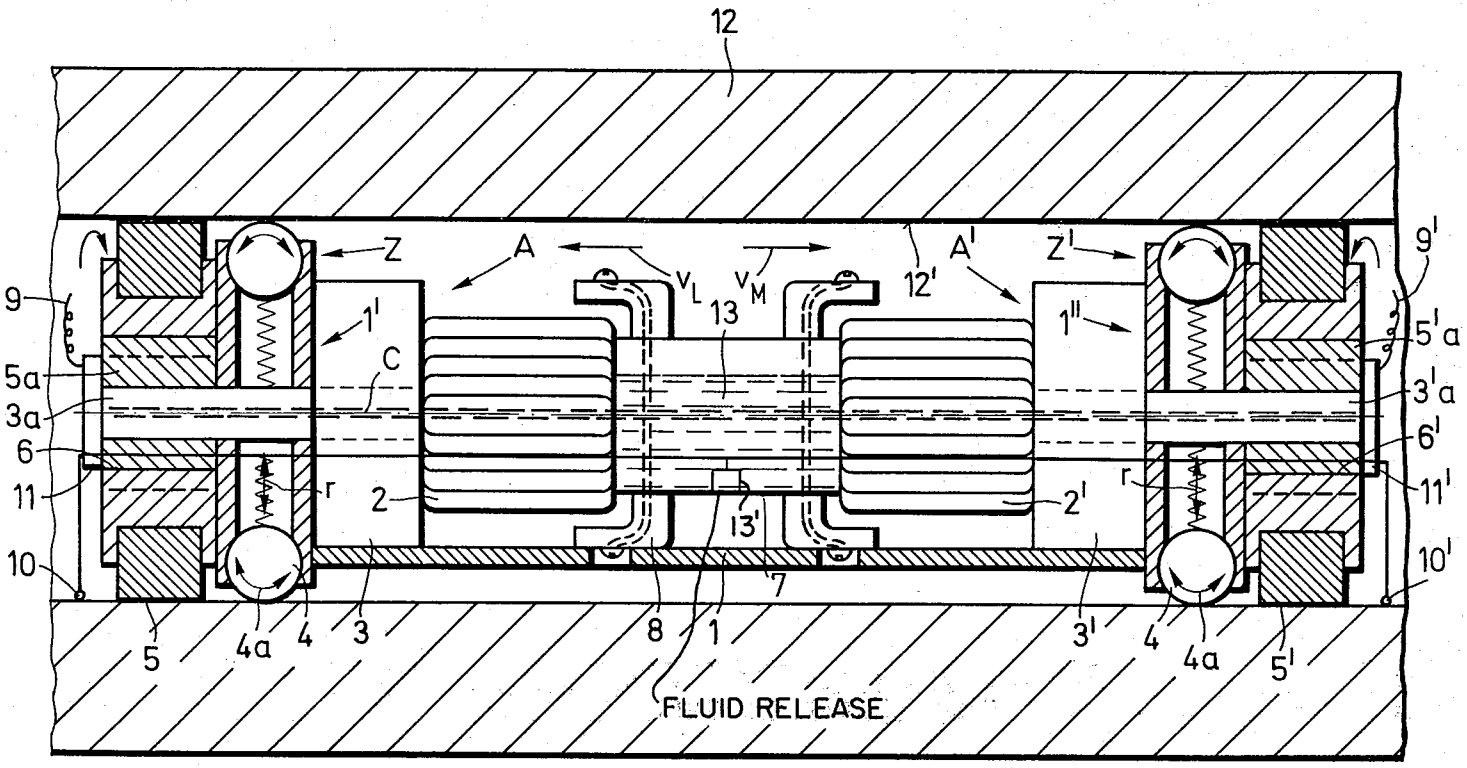
FLUID RELEASE

ARRANGEMENT FOR REMOVAL OF RESIDUES AND SEDIMENTS FROM THE INTERIOR SURFACES OF BARRELS OF WEAPONS

BACKGROUND OF THE INVENTION

It is essential to clean the barrels of weapons periodically and this requires considerable time and human effort. For example, for cleaning the interior of a gun barrel having a 120 mm caliber, a brush is used corresponding to the caliber of the weapon which must be coaxially mounted on a rod of 6 meters length. Such a brush or broom when used to clean the gun barrel requires the service of seven persons.

In addition to the drawback of requiring large time and labor input, the cleaning operation must be carried out during working hours which causes the loss of valuable working time by the personnel performing the cleaning so that this personnel is unavailable for other important activities. In addition thereto, the weapon, for example, a tank, is not available for use during the cleaning process.

SUMMARY OF INVENTION

It is a general object of the invention to provide a cleaning arrangement for the barrels of weapons of large caliber, in which the afore-described drawbacks are eliminated or mitigated, and which simultaneously has a reduced spatial requirement, is easily operated and, consequently, is more easily mounted in the weapon installation and more easily transported with it.

The advantages of the invention reside in the simplicity of the arrangement. It can, so to speak, be used as an accessory to the weapon installation, operated overnight, in urgent cases even during marching of the weapon personnel or transporting of the weapon installation or during its utilization for teaching purposes.

BRIEF DESCRIPTION OF THE DRAWING

Additional objects of the invention will be brought out in the following description of a preferred embodiment of the cleaning arrangement, taken in conjunction with the accompanying drawing.

The single FIGURE in the drawing illustrates an automatic weapon-barrel cleaning installation in accordance with the invention, shown mounted in the barrel of a weapon, the drawing being in longitudinal cross-sectional axial schematic view, in which non-essential details which do not affect the invention, have been omitted.

DETAILED DESCRIPTION

The weapon-barrel-cleaning arrangement, hereinafter referred to as the "arrangement", includes a base plate 1, to which are rigidly secured at opposite axial ends thereof the support arrangements 1' and 1''. Each one of the support arrangements 1' and 1'' co-acts with a drive motor 2, 2' respectively, which is mounted on a drive gear 3, 3' respectively. The drive motor 2 (2') and drive gear 3 (3') form a drive unit A(A'). A drive shaft 3*a* (3'*a*) extends through the support arrangement 1' (1'') and is co-axially connected at its free end to a rotary brush receiving member 6 (6'). The brush receiving member 6 (6') and the cylindrical brush support 5*a* (5'*a*) are adapted to be screw-connected or bayonet-connected to each other so that the connection is adapted to absorb torque forces during rotation. The support arrangements 1' and 1'' are essentially circular in cross section and support at their outer periphery radially biased drive rollers so that the arrangement is self-centering. The drive rollers bear against the inner surface 12' of the weapons-barrel. The biasing in the radial direction of the drive rollers 4 is indicated by the double arrow "r". The drive rollers 4 are mounted equidistant from each other along the periphery of the drive arrangement 1 (1'') and are driven via the drive motors 2, (2') and drive gear trains 3, (3') in the direction of the double arrow 4*a* by means which are not illustrated in detail. Such drive arrangements, having roller drum means, are conventional and are, for example, disclosed in Italian patent No. 720,816. In the middle region of a central axis of the arrangement there is disposed a container 7 for a fluid medium 13, i.e., a cleaning fluid. A conventional switching arrangement 11 (11'), only schematically illustrated, includes a feeler 10 (10') which serves as a signal emitting means. The feelers 10 (10') forming part of the switching means are of the conventional inductive proximity switch type. For supplying electrical energy to the motors 2 and 2', there are respectively provided electrical conduits 9 and/or 9'. The switching members 11 (11') respectively switch the drive arrangements A and A' via the feelers 10 and 10'. The switching arrangement 11 (11') further includes an adjustable single emitter for releasing the fluid medium 13 via a releasing means 13 mounted in the container 7 but not illustrated in detail. The switching means 11 (11') are adjustable pursuant to a predetermined program.

The operation and use of the cleaning arrangement of the invention is carried out as follows:

The installation is mounted inside the weapon barrel 12. The conduit 9 and/or 9' can be connected via the gun barrel mouth and/or the loading chamber to a source of electrical energy, for example a electrical supply network. The cleaning arrangement is inserted into the mouth of the gun barrel and is moved first of all in the direction of the arrow $v_l$ towards the loading chamber. The brushes 5 and 5' rotate in opposite directions while the drive rollers 4 provide, by means of radially biased mounting, the necessary centering as well as the necessary advance in the axial direction of the cleaning arrangement in the barrel 12. As soon as the feeler 10 passes the point where the gun barrel meets the loading chamber, a switching is effected. The cleaning installation still moves in the direction of the arrow $v_l$ until the brush 5 has reached a limit where the transition from gun barrel to loading chamber is located. The cleaning arrangement now stops and the drive rollers 4 reverse their rotational movement so that the installation now moves in the direction of the arrow $v_M$ until the feeler 10' reaches the mouth of the barrel. There an analog process occurs as occurred at the point of transfer from gun barrel to loading chamber; the cleaning arrangement now returns again towards the loading chamber where it stops again and so on, and so on. Depending on the pre-set program the release of the fluid medium 13 is effected which insures the careful and non-abrasive removal of a layer from the inner surface 12' by means of the rotating brushes 5 and 5'. After the cleaning operation has been completed according to the predetermined program, the installation can, for example, remain at the mouth of the gun barrel and can at an appropriate time be removed from the cleaned gun barrel 12. From the above it will be understood that the foregoing description is merely illustrative of preferred embodiments and specific examples of the present invention, and that variations may be made in such embodiments and examples by those skilled in the art without departing from the spirit and purview thereof.

What is claimed is:

1. An automatic axially reciprocally movable cleaning arrangement for removing residues and sediments from cylindrical bores and in particular gun barrels, wherein said arrangement includes a carrier with at least one drive motor having electrical energy supply means connected thereto and electrical switching means connected to the electrical energy supply means for reversing the rotation of said at least one drive motor, and a container for holding cleaning fluid mounted on the carrier, and rotary brush means operatively connected to said motor, the improvement comprising in combination, a. the rotary brush means being rotated about the longitudinal axis of the gun barrel;

b. drive gear means operatively connected on the one hand to said at least one drive motor and, on the other hand, to said rotary brush means;

c. centering means operatively mounted on said carriers and including a plurality of drive rollers which are continuously biased against the inner surface of the gun barrel; and d. said drive rollers of said centering means being rotated by said drive motor to axially advance said cleaning arrangement in said gun barrel.

2. The cleaning arrangement as set forth in claim 1 including sensing means mounted at the axial ends of said cleaning arrangements and connected to a switching means and adapted to sense when said cleaning arrangement reaches a predetermined region in said gun barrel and to then switch over said drive motor via said switching to thereby reverse its rotary direction.

3. The cleaning arrangement as set forth in claim 2, wherein each rotary brush means is adapted to rotate in a predetermined rotary direction.

* * * * *